US008129890B2

(12) United States Patent
Flesch

(10) Patent No.: US 8,129,890 B2
(45) Date of Patent: Mar. 6, 2012

(54) HIGH-PRESSURE DISCHARGE LAMP HAVING A STARTING AID

(75) Inventor: Peter Flesch, Berlin (DE)

(73) Assignee: Osram AG, Munich (DE)

( * ) Notice: Subject to any disclaimer, the term of this patent is extended or adjusted under 35 U.S.C. 154(b) by 101 days.

(21) Appl. No.: 12/450,682

(22) PCT Filed: May 4, 2007

(86) PCT No.: PCT/EP2007/054332

§ 371 (c)(1),
(2), (4) Date: Oct. 6, 2009

(87) PCT Pub. No.: WO2008/135084

PCT Pub. Date: Nov. 13, 2008

(65) Prior Publication Data

US 2010/0327727 A1 Dec. 30, 2010

(51) Int. Cl.
*H01J 5/16* (2006.01)

(52) U.S. Cl. ..... 313/112; 313/113

(58) Field of Classification Search ..... 313/627–643, 313/567, 111–117, 25–27, 317, 318.01–318.12; 439/615, 739; 445/24, 26, 19
See application file for complete search history.

(56) References Cited

U.S. PATENT DOCUMENTS

| | | | | |
|---|---|---|---|---|
| 2,142,047 | A | 10/1935 | Cox | |
| 4,812,714 | A | 3/1989 | Keeffe et al. | |
| 2005/0140295 | A1 | 6/2005 | Van Den Nieuwenhuizen | |
| 2006/0028141 | A1 * | 2/2006 | Koegler et al. | 313/594 |
| 2006/0232178 | A1 * | 10/2006 | Setzer et al. | 313/113 |

FOREIGN PATENT DOCUMENTS

| | | | |
|---|---|---|---|
| DE | 197 05 763 | A1 | 1/1998 |
| DE | 10 2005 017 505 | A1 | 10/2006 |
| EP | 0 313 028 | A2 | 10/1988 |
| EP | 0 313 028 | A3 | 10/1988 |
| WO | WO 03/085696 | A1 | 10/2003 |
| WO | WO 2006/075259 | A2 | 7/2006 |

* cited by examiner

*Primary Examiner* — Toan Ton
*Assistant Examiner* — Fatima Farokhrooz
(74) *Attorney, Agent, or Firm* — Holtz Holtz Goodman & Chick PC

(57) ABSTRACT

The invention relates to a high-pressure discharge lamp (1) having a burner (2), which is provided with a starting aid device (30, 32) for improving the starting behavior. Said device is configured according to the invention as a grid (30) encompassing the burner in the region of a ceramic (6) holding the burner (2) and having contact with a power feed (24). Said grid (30) acts as a starting aid and as protection against fragments in case of a burner explosion.

10 Claims, 3 Drawing Sheets

HIGH-PRESSURE DISCHARGE LAMP HAVING A STARTING AID

This application is a U.S. National Phase Application under 35 USC 371 of International Application PCT/EP2007/054332, filed May 4, 2007, which is incorporated herein in its entirety by this reference.

TECHNICAL FIELD

The invention relates to a high-pressure discharge lamp in accordance with patent claim 1.

PRIOR ART

Such high-pressure discharge lamps, for example metal-halide lamps and mercury ultra-high-pressure lamps are marketed by OSRAM GmbH under the lamp family designation VIP® and P-VIP and are used, for example, in the sector of multimedia data and video projection. A corresponding lamp construction is also described in DE 10 2005 017 505 A1. These known high-pressure discharge lamps have a burner with a discharge vessel, on which two shafts are formed which are arranged diametrically with respect to one another. Two electrodes, which are connected to power supply lines via sealing foils fused into the shafts, are arranged in the discharge vessel. In order to improve the starting responses, an auxiliary starting device can be provided which engages around a section of a shaft with an auxiliary starting bubble and interacts with one of the electrodes, with the result that the starting operation is assisted when a potential difference is applied. The burner is held on a ceramic, lateral sections of which are open, by means of a joining compound, referred to as cement below.

This auxiliary starting device can be arranged either on that shaft of the burner which is at the front in the emission direction or on the ceramic-side rear shaft. The lastmentioned alternative has the advantage that the luminous efficiency is slightly increased in comparison with an auxiliary starting device arranged in the front burner region.

Since part of the burner is accommodated in the ceramic by virtue of the cement, overheating can result in these regions since the emission of heat and convection cooling is impeded by the ceramic. In order to assist the dissipation of heat, the ceramic is designed to have lateral cutouts, with the result that overheating of the burner shaft is prevented in this region. In order to prevent fragments emerging from the laterally open ceramic in the event of an explosion of the burner, solutions are known from the prior art in which the laterally open regions are covered by means of wire gratings, with the result that cooling of the sections accommodated in the ceramic is possible as a result of heat emission and convection.

One disadvantage with such discharge-lamps is the fact that a comparatively high degree of complexity is involved in the improvement of the starting response and in ensuring the operational reliability (protection against shattering).

DESCRIPTION OF THE INVENTION

The object of the present invention is to provide a high-pressure discharge lamp in which the protection against shattering and the starting response are improved with little complexity in terms of apparatus.

This object is achieved by a high-pressure discharge lamp with a burner, which has a discharge vessel and two shafts arranged coaxially with respect to one another and in which two mutually spaced-apart electrodes are accommodated.

Said electrodes are connected to power supply lines via sealing foils fused into the shafts, an auxiliary starting device engaging around the section of a shaft with an auxiliary starting bubble and interacting with one of the electrodes in order to improve the starting response. The burner is held on a ceramic by means of a joining compound. The invention provides for the auxiliary starting device to be arranged in the ceramic as protection against shattering.

Particularly advantageous refinements of the invention are given in the dependent patent claims.

According to the invention, the auxiliary starting device therefore has a dual function, since it firstly improves the starting response and secondly acts as protection against shattering. As a result, the structural complexity for realizing the high-pressure discharge lamp can be significantly reduced in comparison with conventional solutions, in which the auxiliary starting device and the protection against shattering are always provided by functionally independent devices.

By moving the auxiliary starting device into the region of the ceramic, the luminous efficiency can be increased in comparison with solutions in which the starting aid is arranged in the front burner region.

In an exemplary embodiment according to the invention, the high-pressure discharge lamp is in the form of a reflector lamp, with the reflector likewise being held on the ceramic.

Contact can be made with the auxiliary starting device for example, via an auxiliary starting wire, which is connected to one of the power supply lines. Alternatively, the power supply line can be positioned, for example, with respect to the burner side which is at the front in the emission direction such that said power supply line is guided past the auxiliary starting device, with the result that direct contact with this power supply line can be made.

Correspondingly, the power supply line is then guided axially through the reflector. Alternatively, the power supply line can also be guided laterally through the reflector, in which case said auxiliary starting wire would appear to be necessary for making contact.

The auxiliary starting device in the form of a grating is preferably inserted into a through-bore of the ceramic with a certain prestress.

In a solution which has a particularly simple design, the grating is approximately in the form of a cylinder casing.

The high-pressure discharge lamp is preferably in the form of a mercury ultra-high-pressure lamp or a metal-halide lamp. In principle, however, other lamp types with an auxiliary starting device acting as protection against shattering can also be implemented.

BRIEF DESCRIPTION OF THE DRAWINGS

The invention will be explained in more detail below with reference to an exemplary embodiment. In the figures.

PREFERRED EMBODIMENT OF THE INVENTION

Figure 1:
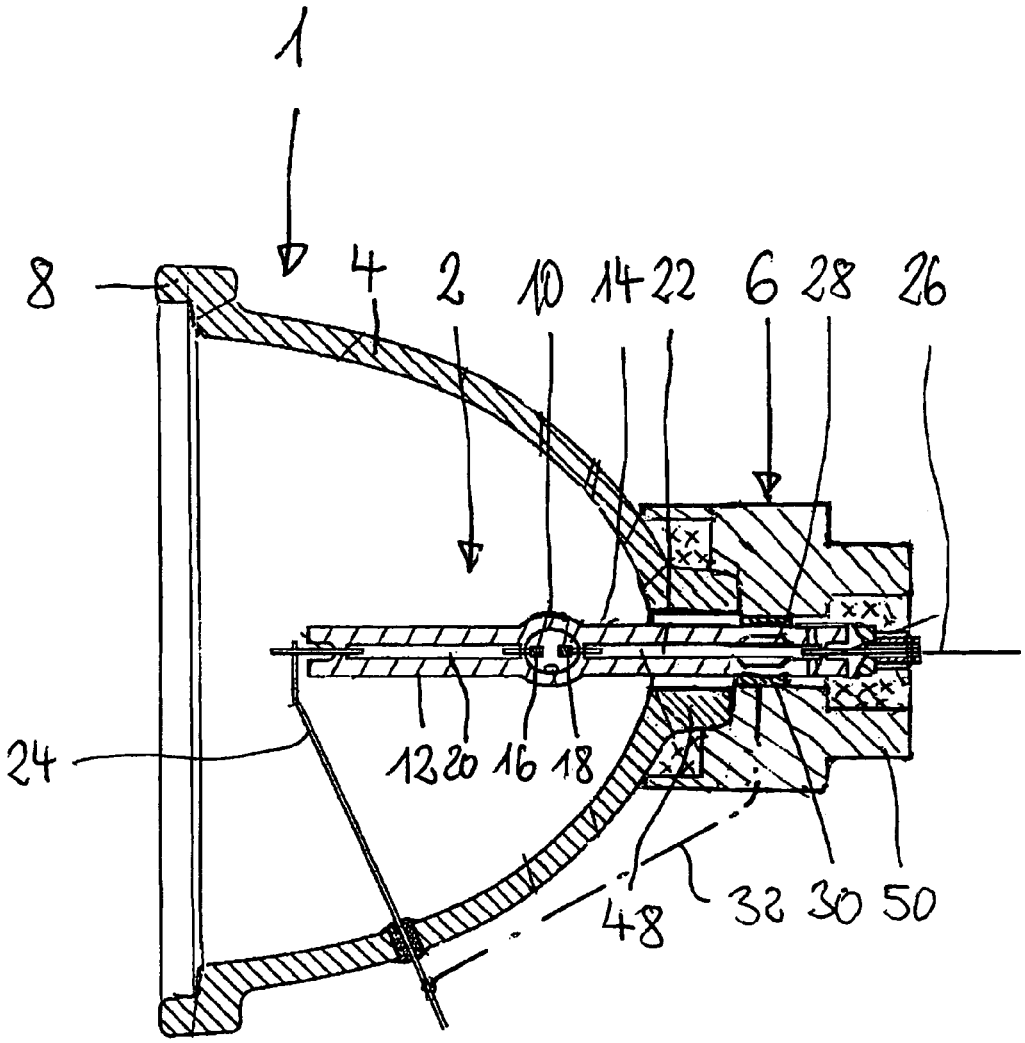
FIG. 1 shows a schematic longitudinal section through a high-pressure discharge lamp according to the invention.

FIG. 1 shows a simplified longitudinal section through an exemplary embodiment of a high-pressure discharge lamp 1. Said lamp is in the form of a reflector lamp and has a burner 2, which is jointly inserted with a reflector 4 into a ceramic 6.

The reflector 4 is made from glass, for example, and is provided with a reflective coating. A front-side screen or front cover can be inserted into a flange rim 8 which is at the front in the emission direction of the lamp, with the result that the surrounding environment is protected towards the front in the event of an explosion of the burner. The burner 2 substantially comprises an approximately centrally arranged discharge vessel 10, on which two shafts 12, 14 are arranged which are arranged in the axis of the reflector 4. Two mutually spaced-apart electrodes 16, 18, which are made from tungsten, for example, are arranged in the discharge vessel 10, and contact is made between said electrodes and power supply lines 24, 26 via sealing foils 20, 22 made from molybdenum which are fused into the shafts 12, 14. In the exemplary embodiment illustrated, the power supply line 24 associated with the front shaft 12 is guided laterally through a sealed bore in the reflector 4. The power supply line 26 associated with the rear shaft 14 runs axially through the ceramic 6. In principle, it is also possible to guide the front power supply line 24 along the burner 2 through the ceramic 6.

In the case of a high-pressure discharge lamp, the discharge vessel 10 can be filled with a fill having components mercury, metal halides, rare earths and a noble gas mixture, with the result that the discharge arc burns between the two electrodes 16, 18 in an atmosphere of halogen and mercury vapor and a high pressure. The lamp may also be a mercury ultra-high-pressure lamp.

The design of the ceramic-side part of the high-pressure discharge lamp 1 will be explained with reference to the enlarged illustration in FIG. 2.

Accordingly, an auxiliary starting bubble 28 is formed in the region of the sealing foil fuse seal on the rear shaft 14 which faces the ceramic 6, via which bubble, in a manner known per se (see DE 10 2005 017 505 A1), the starting response of the discharge lamp 1 can be improved. In the region of this auxiliary starting bubble 28, a grating 30, which is approximately in the form of a cylinder casing and engages around sections of the outer circumference of the shaft 14, is inserted into the ceramic 6. This grating 30 is connected to the power supply line 24 of the front shaft 12 via an auxiliary starting wire 32, which is indicated by dash-dotted lines in FIGS. 1 and 2, with the result that said grating 30 makes contact with the same potential as the front electrode 16.

In this case, approximately the same potential difference is present between the grating 30 and the sealing foil 22, which is associated with the rear electrode 18 and passes through the bubble 28, as between the two electrodes 18, 22. During starting of the lamp using a conventional electronic ballast, a corresponding discharge with a corresponding emission of radiation is set in the auxiliary starting bubble 28 with the result that the bubble acts as starting aid. In preliminary tests, the grating 30 around the auxiliary starting bubble 28 was brought to the same potential as the sealing foil 22 in the shaft 14, in this case the auxiliary starting bubble 28 does not illuminate during starting of the high-pressure discharge lamp. In the case in which no contact is made with the grating 30, the auxiliary starting bubble 28 does not start, or only starts with flicker, which provides proof of the fact that this grating 10 can fulfill the dual function described at the outset (protection against shattering and starting aid).

Figure 2:
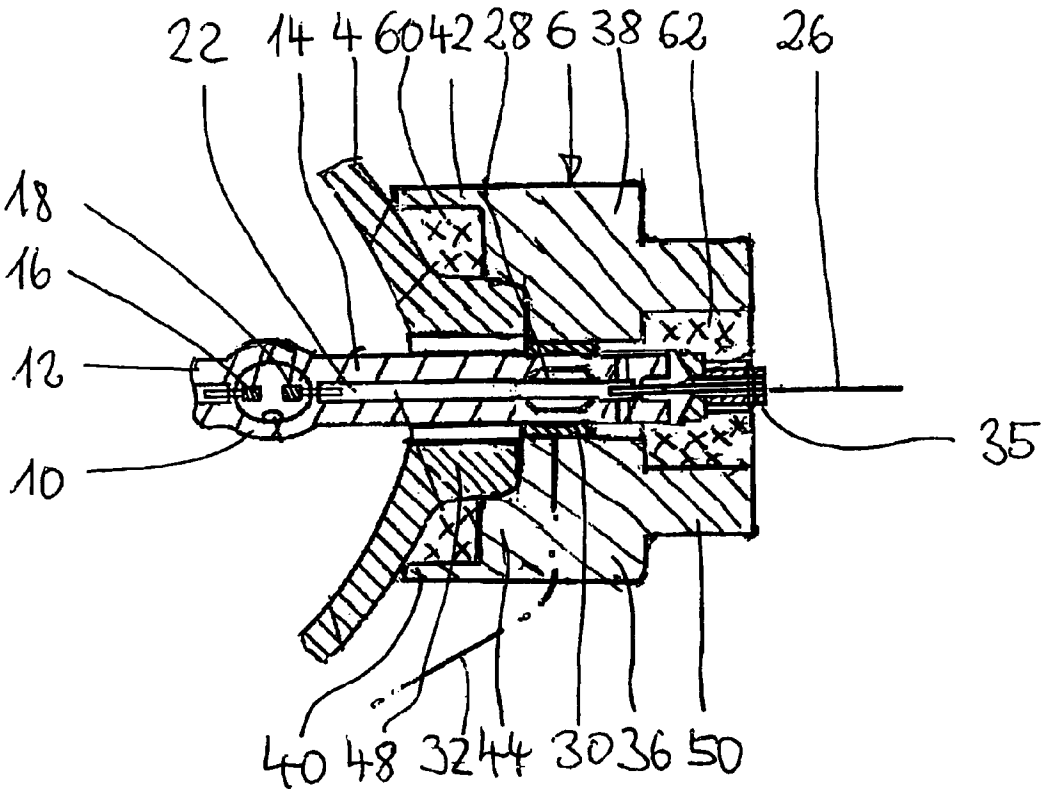
FIG. 2 shows a subregion of the high-pressure discharge lamp shown in FIG. 1 in an enlarged illustration.

A base 35, from which the power supply line 26 extends, is provided on that end section of the shaft 14 which is on the right in FIG. 2.

Figure 3:
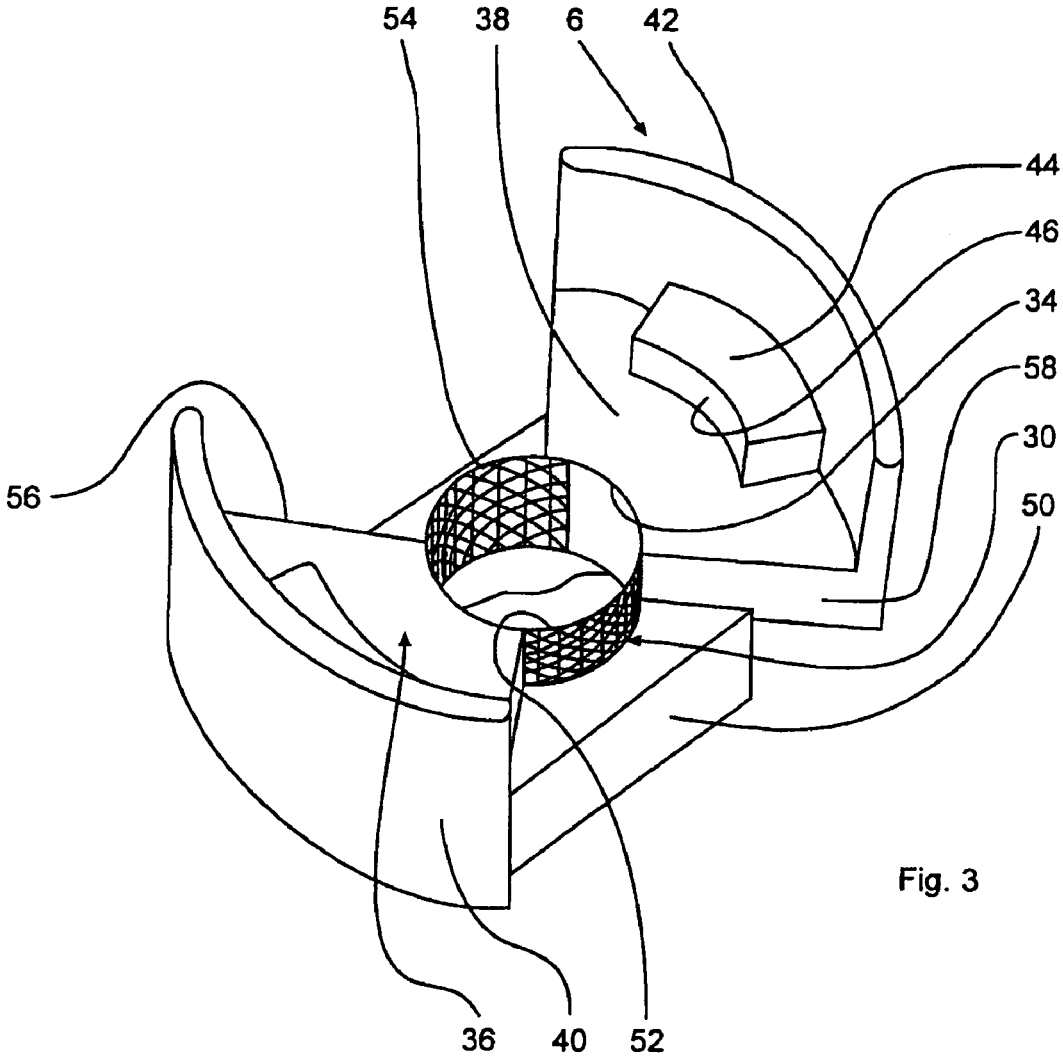
FIG. 3 shows a three-dimensional illustration of a ceramic of the high-pressure discharge lamp shown in FIGS. 1 and 2.

The design of the ceramic with the grating 30 inserted therein is explained with reference to FIG. 3. Said figure shows a three-dimensional illustration of the ceramic 6, into which the grating 30 is inserted. Said grating is formed from a rectangular grating strip, whose extended length is slightly shorter than the circumference of a through-bore 34 in the ceramic 6. Owing to its spring effect, the grating 30 can be held in the through-bore 34. In principle, however, it is also possible for the grating 30 to be fixed by suitable measures, for example by means of cement or the like. The ceramic 6 illustrated in FIG. 3 is a standard component part which can also be used in conventional discharge lamps in which the grating 30 is not provided. Since the basic design is known per se, only a few essential elements of the ceramic 6 will be described. Said ceramic has two sections 36, 38 in the form of segments of a circle which are at the top in FIG. 3 and are delimited in the radial direction in each case by a cylinder casing surface section 40, 42, which forms a reflector receptacle and which protrudes axially parallel toward the reflector 4 in the illustration shown in FIG. 2. In the transition section between the cylinder casing surface section 40, 42 and the associated section 36, 38 in the form of a segment of a circle, in each case one centering cam 44 is formed, which bears with its centering shoulder 46 (shown in FIG. 2) on the outer circumference of a reflector neck 48.

A toggle-shaped diametric projection 50, whose maximum outer diameter is less than that of the cylinder casing surface sections 40, 42, is formed on the rear side of the ceramic 6, which rear side faces away from the viewer and is at the bottom in FIG. 3. During installation of the high-pressure discharge lamp 1, a cap (not illustrated) is positioned onto this diametric projection 50 (see in particular FIG. 2), and the rear power supply line 26 extends in the radial direction out of said cap.

The ceramic 6 is cut free between the two sections 36, 38 in the form of segments of a circle by means of wedge-shaped recesses 56, 58, with the result that, correspondingly, circumferential sections 52, 54 of the grating 30 are exposed. These sections run above and below the plane of the drawing in the illustration shown in FIG. 2 and are therefore not visible.

Without this grating 30, fragments of the burner 2 could emerge in a radial direction from the ceramic 6 in the event of an explosion of the burner, but this is reliably prevented by the inserted grating 30. The wedge-shaped recesses 56, 58 of the ceramic 6 ensure that an accumulation of heat in that section of the shaft 14 which is accommodated in the ceramic 6 is avoided, with the result that excessive thermal loading does not occur in this region.

As can be seen in particular from FIG. 2, during installation of the high-pressure discharge lamp 1, the reflector 4 is inserted with its reflector neck 48 into the reflector receptacle of the ceramic 6, which reflector receptacle is formed by the sections 36, 38 in the form of segments of a circle and the cylinder casing sections 40, 42, and is connected to the base 35 by means of cement 60 which is resistant to high temperatures. In a subsequent working step, the burner is inserted into the reflector 4, with the result that the rear shaft 14 passes through the reflector neck 48, the through-bore 34 of the ceramic 6 and the grating 30 accommodated therein, with the result that the base 35 ends in the region of the diametric projection 50. After the alignment with respect to the reflector 4, the burner 2 is likewise fixed in position in the ceramic 6 and with reference to the reflector 4 by means of cement 62, with the result that the maximum luminous efficiency is ensured.

In the exemplary embodiment illustrated, contact is made with the grating 30 via the auxiliary starting wire 32, which is connected to the power supply line 24, which is passed laterally out of the reflector 4. As mentioned at the outset, this power supply line 24 could also be guided past the grating 30 axially parallel through the reflector neck 48 and contact could be made between said power supply line and said grating, with the result that a separate auxiliary starting wire is not required. In such a solution, there is no need for the comparatively expensive auxiliary starting wire 32. Furthermore, in the solution according to the invention, less material is required for the grating 30 since said grating is arranged directly on the burner 2, while the grating 30 is arranged at a comparatively large radial distance from the burner 2 or more specifically from the adjacent shaft in the known solutions described at the outset, with the result that the circumference is correspondingly enlarged. The ceramic 6 described with reference to FIG. 3 can be used for lamps with an anti-shatter grating and also without an anti-shatter grating, with the result that the manufacture and warehousing are possible with minimum complexity involved.

Another device can also be provided instead of the grating 30, via which device starting of the bubble 28 is made possible and which can act as protection against shattering. The invention has been explained with reference to a high-pressure discharge lamp, but in principle the concept according to the invention with a starting aid acting as protection against shattering can also be used with other lamp types.

The invention discloses a high-pressure discharge lamp with a burner which is provided with an auxiliary starting device in order to improve the starting response. According to the invention, this auxiliary starting device is a grating which engages around the burner in the region of a ceramic holding the burner, with contact being made between said grating and one of the power supply lines. Said grating acts as starting aid and as protection against shattering in the event of an explosion of the burner.

The invention claimed is:

1. A high-pressure discharge lamp (1) with a burner (2), which has a discharge vessel (10) with shafts (12, 14) arranged diametrically thereon and in which two mutually spaced-apart electrodes (16, 18) are accommodated, which are connected to power supply lines (24, 26) via sealing foils (20, 22) fused into the shafts (12, 14), an auxiliary starting device (30, 32) engaging around a section of a shaft (14) with an auxiliary starting bubble (28) and interacting with one of the electrodes (14) as starting aid, the burner (2) being held on a ceramic (6), characterized in that the auxiliary starting device (30, 32) is arranged in the region of the ceramic (6) as protection against shattering and the auxiliary starting device has a grating (30).

2. The high-pressure discharge lamp as claimed in claim 1, the burner (2) being inserted into a reflector (4), which is likewise held on the ceramic (6).

3. The high-pressure discharge lamp as claimed in claim 1, the grating (30) being inserted into the ceramic (6).

4. The high-pressure discharge lamp as claimed in claim 1, contact being made between the grating (30) and one of the power supply lines (24, 26).

5. The high-pressure discharge lamp as claimed in claim 1 or 2, said lamp being a mercury ultra-high-pressure lamp.

6. The high-pressure discharge lamp as claimed in claim 1 or 2 said lamp being a high-pressure discharge lamp.

7. The high-pressure discharge lamp as claimed in claim 2, the grating (30) being clamped or inserted, with prestress, into a through-bore (34) of the ceramic (6).

8. The high-pressure discharge lamp as claimed in claim 2, the grating (30) being designed to be approximately in the form of a cylinder casing.

9. The high-pressure discharge lamp as claimed in claim 3, the power supply line (26) being passed through a reflector neck (48).

10. The high-pressure discharge lamp as claimed in claim 4, the power supply line (26) being passed laterally through the reflector (4).

* * * * *